US012013194B2

(12) United States Patent
Retersdorf

(10) Patent No.: US 12,013,194 B2
(45) Date of Patent: Jun. 18, 2024

(54) ASYMMETRIC CROSS COUNTER FLOW HEAT EXCHANGER

(71) Applicant: Hamilton Sundstrand Corporation, Charlotte, NC (US)

(72) Inventor: Alan Retersdorf, Avon, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 16/397,772

(22) Filed: Apr. 29, 2019

(65) Prior Publication Data

US 2020/0340761 A1 Oct. 29, 2020

(51) Int. Cl.
*F28F 3/04* (2006.01)
*F28D 9/00* (2006.01)

(52) U.S. Cl.
CPC ..... *F28F 3/04* (2013.01); *F28D 9/0093* (2013.01); *F28D 9/0068* (2013.01); *F28F 2250/108* (2013.01)

(58) Field of Classification Search
CPC ..... F28D 9/0068; F28D 9/0093; F28F 2250/108; F28F 3/04
See application file for complete search history.

(56) References Cited

U.S. PATENT DOCUMENTS 3,198,248 A * 8/1965 Stack ..... F28F 21/04 165/166
3,525,390 A 8/1970 Rothman
3,613,782 A * 10/1971 Mason ..... F28D 9/0068 165/166
3,860,065 A * 1/1975 Schauls ..... F28F 3/027 165/166
4,330,308 A * 5/1982 Grenier ..... F25J 5/002 165/166
5,099,913 A * 3/1992 Kadle ..... B60H 1/3227 165/147

(Continued)

FOREIGN PATENT DOCUMENTS

CN 103256839 A * 8/2013
EP 1830149 A1 9/2007

(Continued)

OTHER PUBLICATIONS

Translation of JP-60238687-A entitled Translation—JP-60238687-A (Year: 2021).*

(Continued)

*Primary Examiner* — Paul Alvare
(74) *Attorney, Agent, or Firm* — Kinney & Lange, P.A.

(57) ABSTRACT

A hot layer adapted for use in an asymmetric cross counter flow heat exchanger core that includes a number of alternating hot and cold layers, a hot inlet tent configured to receive a hot inlet flow and defining a hot inlet tent width, and a hot outlet tent configured to discharge a hot outlet flow and defining a hot outlet tent width. A hot inlet closure bar is located adjacent to the hot inlet tent, a hot outlet closure bar is located adjacent to the hot outlet tent, and two hot side closure bars are each located adjacent to respective corresponding inlet and outlet hot fins. An angle between the inlet fin direction and the middle fin direction ranges from 5-175 degrees, and the hot inlet tent width is less than the hot outlet tent width.

20 Claims, 6 Drawing Sheets

(56) References Cited

U.S. PATENT DOCUMENTS

| | | | | |
|---|---|---|---|---|
| 5,915,469 | A | 6/1999 | Abramzon et al. | |
| 5,918,368 | A * | 7/1999 | Ervin | F28D 9/0018 29/890.03 |
| 6,460,613 | B2 * | 10/2002 | Nash | F28D 9/0043 165/146 |
| 7,228,892 | B2 | 6/2007 | Lagerstrom et al. | |
| 9,819,044 | B2 | 11/2017 | De Vos et al. | |
| 2003/0116311 | A1 * | 6/2003 | Fitzpatrick | F28F 21/082 165/170 |
| 2017/0234622 | A1 | 8/2017 | Mizushita et al. | |
| 2018/0010820 | A1 | 1/2018 | Hirsch et al. | |
| 2020/0173882 | A1 * | 6/2020 | Kroener | G01M 99/002 |

FOREIGN PATENT DOCUMENTS

| | | | | |
|---|---|---|---|---|
| JP | 5938598 | A | 3/1984 | |
| JP | 60238687 | A * | 11/1985 | F28D 9/0068 |

OTHER PUBLICATIONS

Translation of Chinese Patent Document CN103256839A entitled Translation—CN103256839A (Year: 2013).*

Understanding Heat Exchangers—Cross-flow, Counter-flow (Rotary/Wheel) and Cross-Counter-flow Heat Exchangers, Feb. 26, 2014, 18 pages.

Extended European Search Report dated Jun. 22, 2020, received for corresponding European Application No. 19212865.0, 5 pages.

* cited by examiner

ASYMMETRIC CROSS COUNTER FLOW HEAT EXCHANGER

STATEMENT OF GOVERNMENT INTEREST

This invention was made with Government support under Contract No. FA8626-16-C-2139 awarded by the Department of the Air Force. The Government has certain rights in the invention.

CROSS-REFERENCE TO RELATED APPLICATION(S)

Reference is hereby made to U.S. patent application Ser. No. 16/397,788, entitled "OFFSET/SLANTED CROSS COUNTER FLOW HEAT EXCHANGER", which was filed on the same date as this application.

BACKGROUND

The present disclosure relates to heat exchangers, and more particularly, to cross counter flow plate-fin heat exchangers that reduce thermal stress and/or improve thermal performance.

Plate-fin heat exchangers are known in the aviation arts and in other industries for providing a compact, low-weight, and highly-effective means of exchanging heat from a hot fluid to a cold fluid. A cross counter flow plate-fin heat exchanger configuration can be used to provide optimum overall thermal performance in various applications including precooler and fan duct heat exchangers. The design of modern high-performance aircraft requires achieving maximum thermal performance from a heat exchanger having a limited physical size, yet being able to provide effective cooling while operating at elevated temperatures. Disadvantages of existing cross counter flow plate-fin heat exchangers include shortened service lives and/or increased maintenance requirements as a result of high cyclic thermal stress, and limited cooling capacity as a result of flow resistance and/or size limitations.

SUMMARY

A hot layer adapted for use in an asymmetric cross counter flow heat exchanger core that includes a number of alternating hot and cold layers, a hot inlet tent configured to receive a hot inlet flow and defining a hot inlet tent width, and a hot outlet tent configured to discharge a hot outlet flow and defining a hot outlet tent width, the hot layer including a number of inlet hot fins defining an inlet fin direction, a number of middle hot fins defining a middle fin direction, a number of outlet hot fins defining an outlet fin direction, a hot inlet closure bar located adjacent to the hot inlet tent, a hot outlet closure bar located adjacent to the hot outlet tent, and two hot side closure bars, each located adjacent to respective corresponding inlet hot fins and outlet hot fins. An angle between the inlet fin direction and the middle fin direction ranges from 5-175 degrees, and the hot inlet tent width is less than the hot outlet tent width.

A hot layer adapted for use in an asymmetric cross counter flow heat exchanger core that includes a number of alternating hot and cold layers, a hot inlet tent configured to receive a hot inlet flow and defining a hot inlet tent width, and a hot outlet tent configured to discharge a hot outlet flow and defining a hot outlet tent width, the hot layer including a number of inlet hot fins defining an inlet fin direction, a number of middle hot fins defining a middle fin direction, a number of outlet hot fins defining an outlet fin direction, a hot inlet closure bar located adjacent to the hot inlet tent, a hot outlet closure bar located adjacent to the hot outlet tent, and two hot side closure bars, each located adjacent to respective corresponding inlet hot fins and outlet hot fins. An angle between the inlet fin direction and the middle fin direction is less than 90 degrees, and the hot inlet tent width is less than the hot outlet tent width.

DETAILED DESCRIPTION

Figure 1:
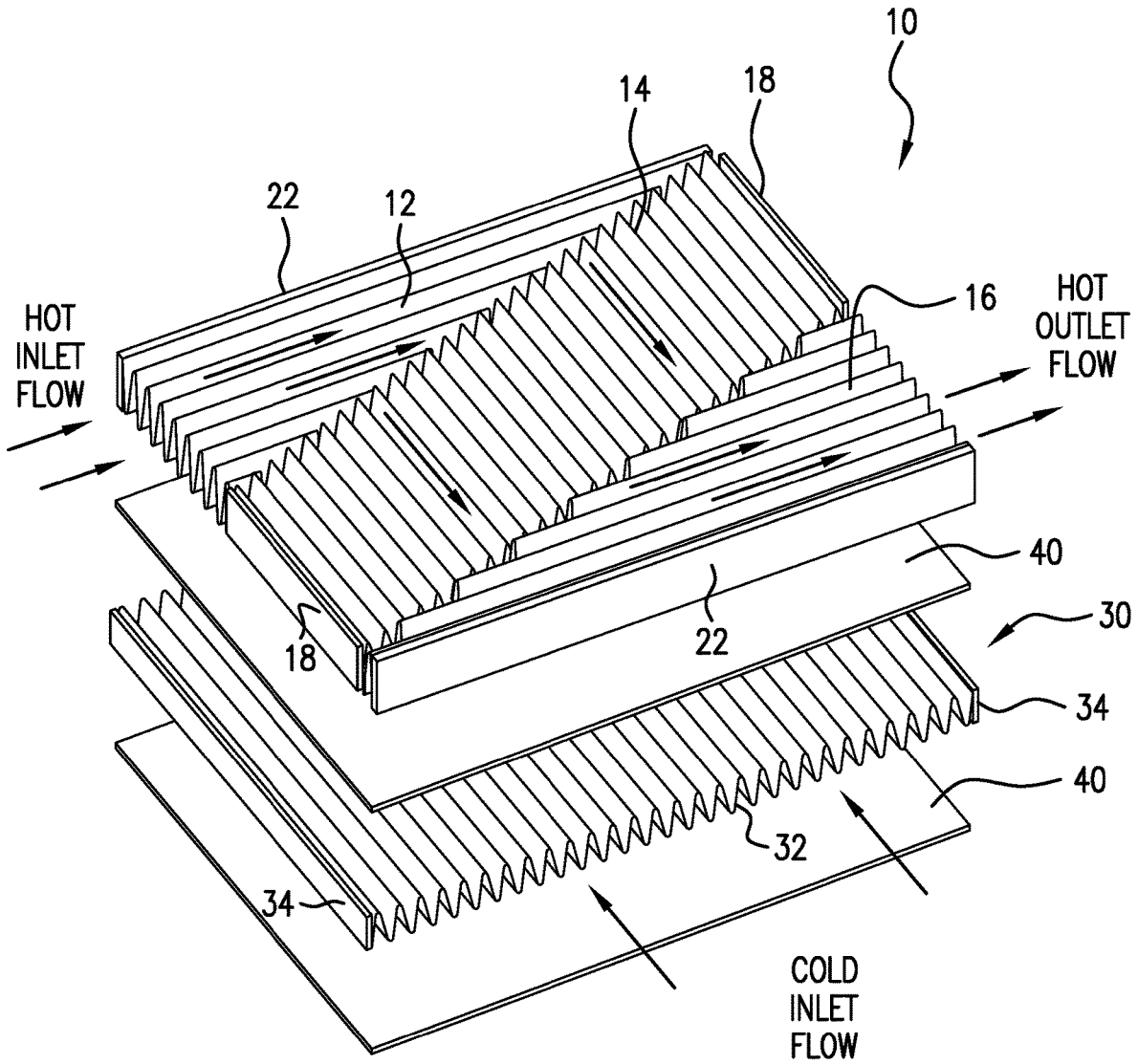
FIG. 1 (Prior Art)
FIG. 1 is an exploded perspective view showing two layers of a cross counter flow plate-fin heat exchanger core of the prior art.
Figure 2A:
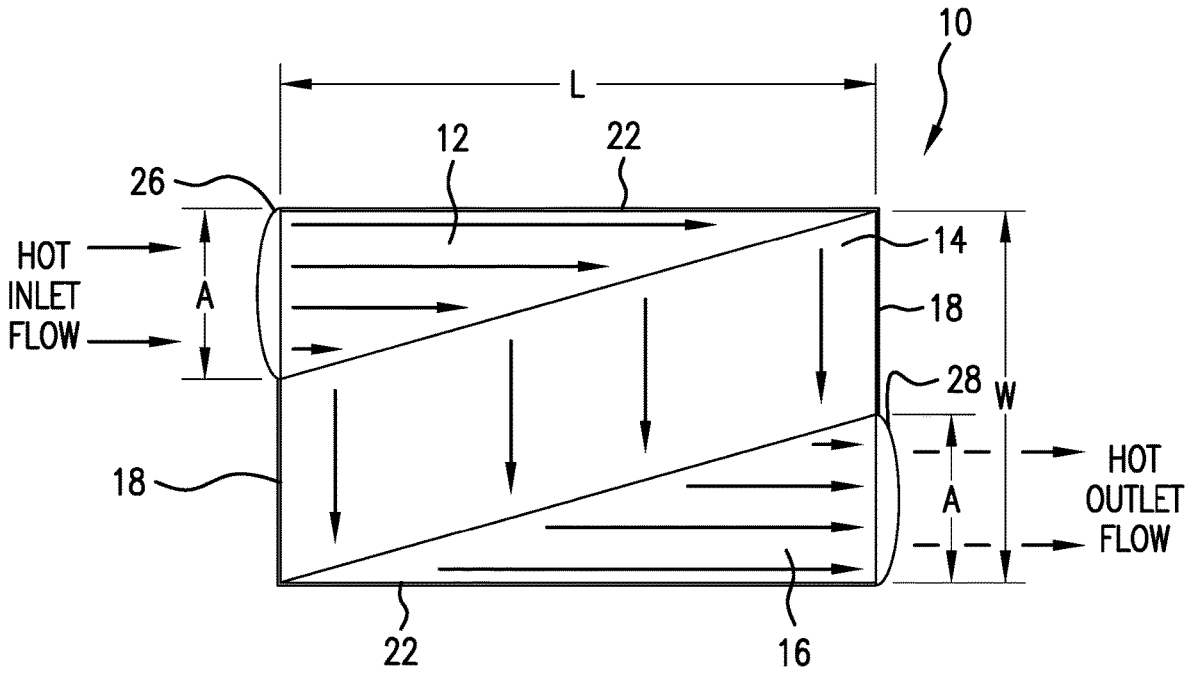
FIG.2A (Prior Art)
FIG. 2A is a top view of a hot layer shown in FIG. 1.
Figure 2B:
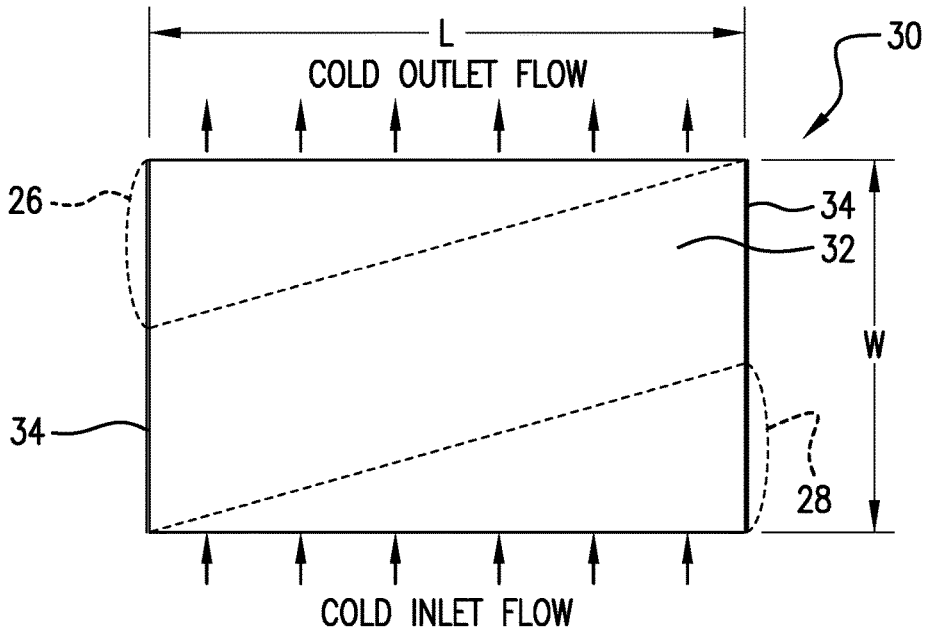
FIG.2B (Prior Art)
FIG. 2B is a top view of a cold layer shown in FIG. 1.

FIG. 1 is an exploded perspective view showing two layers of a cross counter flow plate-fin heat exchanger core of the prior art. FIG. 2A is a top view of hot layer 10 shown in FIG. 1. FIG. 2B is a top view of a cold layer shown in FIG. 1. FIGS. 2A-2B can also be called schematic diagrams because they show the flow schema in hot layer 10 and cold layer 30. Shown in FIGS. 1 and 2A-2B are hot layer 10, hot fins 12, 14, 16, hot end closure bars 18, hot side closure bars 22, hot inlet tent 26, hot outlet tent 28, cold layer 30, cold fins 32, cold closure bar 34, and parting sheets 40. Alternately arranged hot layers 10 and cold layers 30 are sandwiched between parting sheets 40. A hot fluid flows through channels that are formed by hot fins 12, 14, 16 and corresponding parting sheets 40 on the respective top and bottom of a particular hot layer 10. Hot end closure bars 18 and hot side closure bars 22, together with respective parting sheets 40, provide the fluid boundary for a particular hot layer 10. A cold fluid flows through channels that are formed by cold fins 32 and corresponding parting sheets 40 on the respective top and bottom of a particular cold layer 30. Cold closure bars 34, together with respective parting sheets 40, provide the fluid boundary for a particular cold layer 30. The hot fluid changes direction twice moving from the hot inlet flow to the hot outlet flow, thereby resulting in different flow direction orientations with respect to the cold fluid flow. Inlet hot fluid flows through hot fins 12 in a direction that is across (i.e., cross, perpendicular) the direction of cold fluid in cold fins 32. Next, hot fluid flows through hot fins 14 in a direction that is counter (i.e., parallel in the opposing direction) the direction of cold fluid in cold fins 32. Finally, hot fluid flows through hot fins 16 in a direction that is across (i.e., cross, perpendicular) the direction of cold fluid in cold fins 32 prior to exiting hot layer 10. Hot layer 10 and cold layer 30 have length L and width W. Hot inlet tent 26 and hot outlet tent 28 each have tent width A. In the illustrated embodiment, hot fins 12 and hot fins 16, adjacent to corresponding hot inlet tent 26 and hot outlet tent 28, respectively, are symmetrical to each other. In the illustrated embodiment, tent width A is approximately 50% of width W. Hot fluid entering hot layer 10 at hot inlet tent 26 exposes the portion of cold closure bar 34 that is in the vicinity of inlet tent 26 to the temperature of the hot inlet flow. In an exemplary embodiment, the hot inlet flow can be a hot gas having a temperature of 1,200 deg. F. (649 deg. C.). In some embodiments, the hot inlet flow can have a temperature that ranges from 32 deg. F. (0 deg. C.) to 1,200 deg. F. (649 deg. C.). Accordingly, a portion of cold closure bar 34 that is approximately equivalent to tent width A is exposed to hot inlet flow.

Figure 3A:
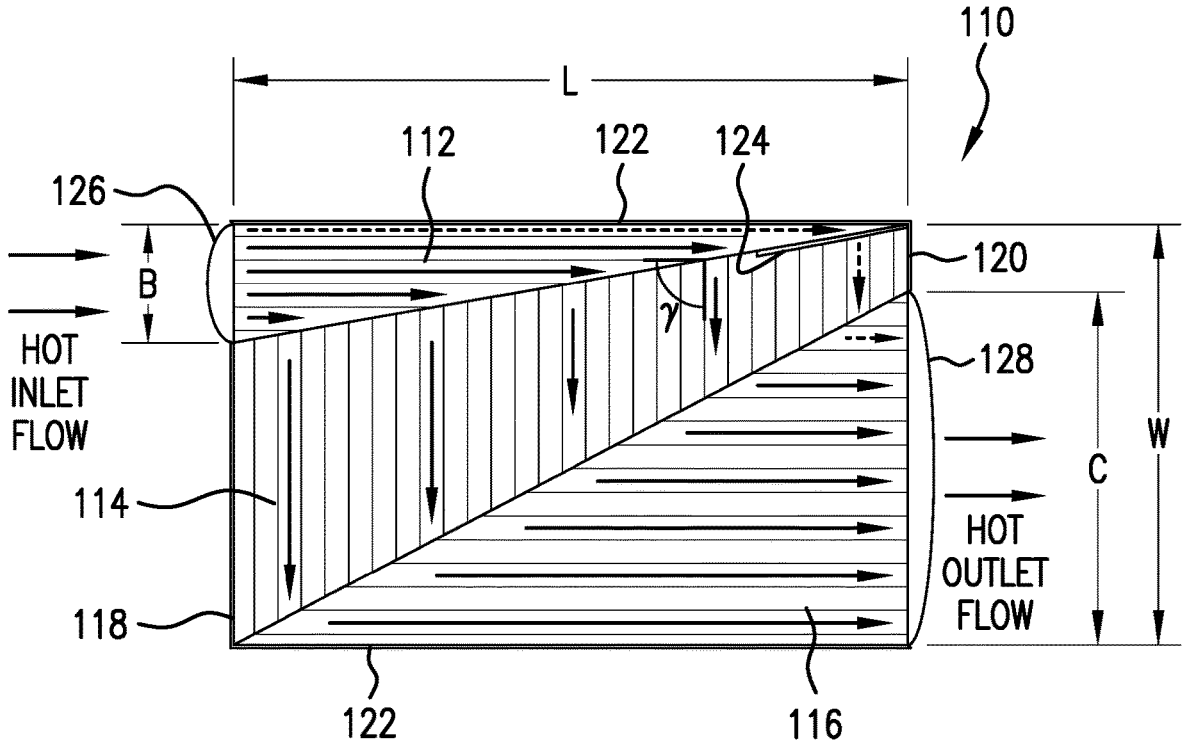
FIG. 3A is a top view of a hot layer of an asymmetric cross counter flow heat exchanger core.
Figure 3B:
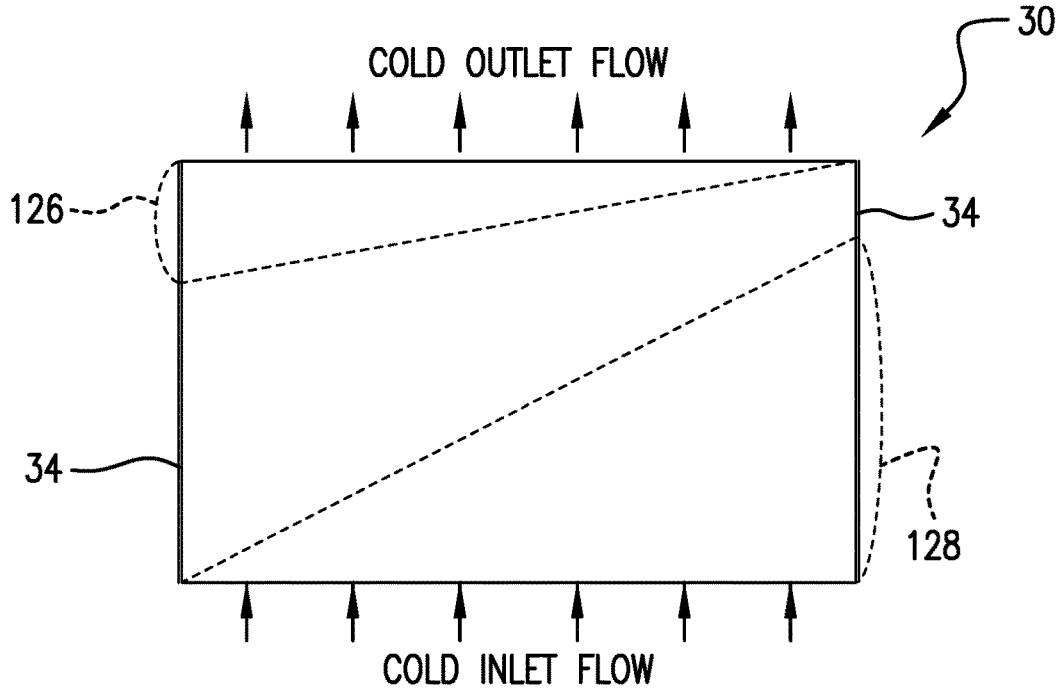
FIG.3B (Prior Art)
FIG. 3B is a top view of a cold layer that can be used with the hot layer shown in FIG. 3A.

FIG. 3A is a top view of a hot layer of an asymmetric cross counter flow heat exchanger core. FIG. 3B is a top view of a cold layer that can be used with the hot layer shown in FIG. 3A Shown in FIGS. 3A-3B are cold layer 30, cold closure bars 34, hot layer 110, inlet hot fins 112, middle hot fins 114, outlet hot fins 116, hot inlet closure bar 118, hot outlet closure bar 120, hot side closure bars 122, flow restrictor 124, hot inlet tent 126, and hot outlet tent 128. Hot layer 110 can also be referred to as a first layer. Similarly, cold layer 30 can also be referred to as a second layer. Hot layer 110 has length L and width W. Length L can also be called layer length, and width W can also be called layer width. Middle hot fins 114 form middle fin angle γ with inlet hot fins 112. In the illustrated embodiment, middle fin angle γ is about 90 deg. Hot inlet tent 126 has hot inlet tent width B, and hot outlet tent 128 has hot outlet tent width C. In the illustrated embodiment, hot inlet tent width B is approximately 30% of width W. Hot fluid entering hot layer 110 at hot inlet tent 126 exposes a portion of cold closure bar 34 adjacent to hot inlet tent 126 to the temperature of hot inlet flow. In an exemplary embodiment, the hot inlet flow can have a temperature of 1,200 deg. F. (649 deg. C.). Accordingly, a portion of cold closure bar 34 that is approximately equivalent to tent width B is exposed to hot inlet flow. The portion of cold closure bar 34 that is exposed to the hot inlet flow can be expressed as the ratio of B/W. The ratio of B/W can be referred to as the cold closure bar stress ratio. In the illustrated embodiment, the cold closure bar stress ratio is approximately 30%. In some embodiments, the cold closure bar stress ratio can range from 25-40%. In other embodiments, the cold closure bar stress ratio can range from about 5-50%. Lower values of cold closure bar stress ratio result in less thermal expansion of closure bars 34 and/or less thermal fatigue on cold layers 34, thereby helping prolong the service life of a heat exchanger that includes hot layer 110.

Referring again to FIG. 3A, it can be appreciated that smaller values of hot inlet tent width B (i.e., smaller values of cold closure bar stress ratio) can result in greater resistance to flow as a result of a lesser flow area. Accordingly, the size of hot outlet tent 128 can be increased to help offset the greater resistance to flow at hot inlet tent 126. The greater flow area at hot outlet tent 128 results from the greater size of hot outlet tent width C. The ratio of C/W can be referred to as the hot outlet flow ratio. In the illustrated embodiment, the hot outlet flow ratio is approximately 75%. In some embodiments, the hot outlet flow ratio can range from 65-80%. In other embodiments, the hot outlet flow ratio can range from 50-90%. In yet other embodiments, the hot outlet flow ratio can range from about 10% to nearly 100%. Any values of hot inlet tent width B and hot outlet tent width C are within the scope of the present disclosure, so long as hot outlet tent width C is greater than hot inlet tent width B in a particular embodiment. In the illustrated embodiment, middle fin angle γ is about 90 deg. In some embodiments, middle fin angle γ can range from about 5-175 deg. In other embodiments, middle fin angle γ can range from 5-85 deg. In other embodiments, middle fin angle γ can range from 25-65 deg.

Referring again to FIG. 3A, it can be seen that a short-circuit of hot layer flow can result from the shorter flow path from hot inlet tent 126 to hot outlet tent 128 (depicted as a dashed line in FIG. 3A). Accordingly, to prevent or reduce the above-described short-circuit of hot layer flow, flow restrictor 124 is inserted in a portion of hot layer 110. In the illustrated embodiment, flow restrictor 124 is a partial vertical partition that restricts flow through inlet hot fins 112 and/or middle hot fins 114. Flow restrictor 124 is located near hot outlet closure bar 120, configured to restrict flow through the inlet hot fins, the middle hot fins, and/or the outlet hot fins. In a particular embodiment, flow restrictor 124 can be perforated plate that causes a resistance to flow, thereby helping achieve a more uniform flow density through hot layer 110. In another embodiment, flow restrictor 124 can a partial-height solid plate that partially obstructs a flow through particular hot fins (i.e., inlet hot fins 112, middle hot fins 114, outlet hot fins 116). In some embodiments, flow restrictor 124 can be a particular arrangement of fins that are non-uniform near the shorter flow path region, with non-limiting examples including variation in fin density and/or fin type (e.g., ruffled, straight). Any means of preventing or reducing a greater flow rate from occurring in a shorter flow path region is within the scope of the present disclosure.

Figure 4A:
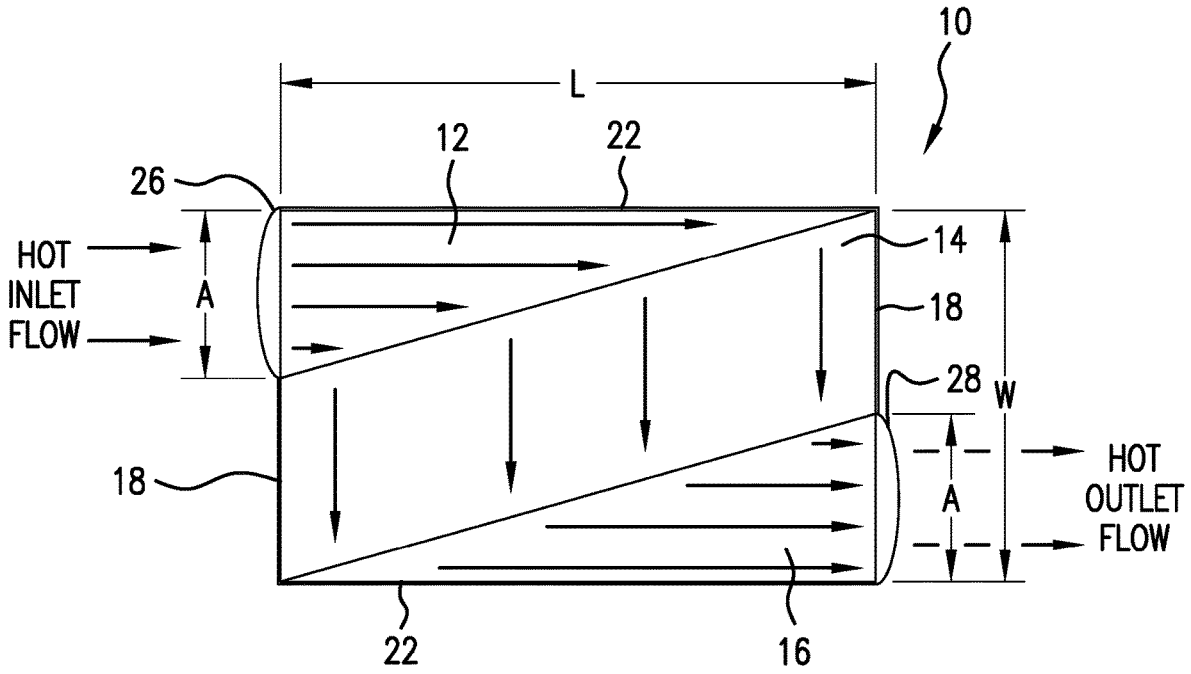
FIG.4A (Prior Art)
FIG. 4A is a top view of the hot layer shown in FIG. 1.
Figure 4B:
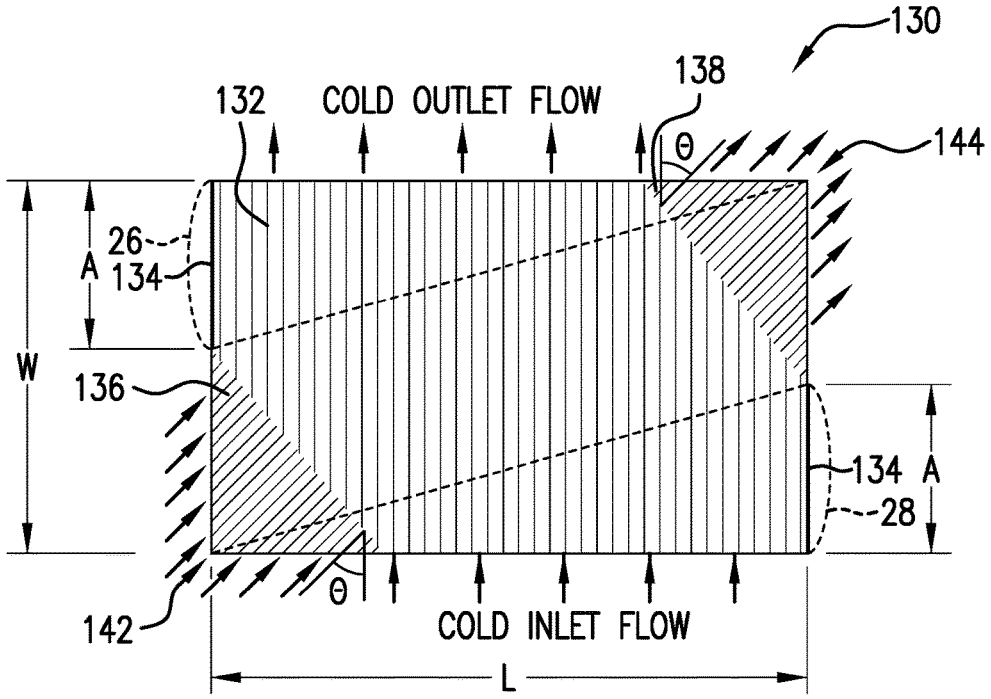
FIG. 4B is a top view of a cold layer of an open concept cross counter flow heat exchanger.

FIG. 4A is a top view of the hot layer of the prior art shown in FIG. 1. FIG. 4B is top view of a cold layer of an open concept cross counter flow heat exchanger, which can be configured to accommodate the hot layer shown in FIG. 4A. Shown in FIGS. 4A-4B are hot layer 10, hot fins 12, 14, 16, hot end closure bars 18, hot side closure bars 22, hot inlet tent 26, hot outlet tent 28, cold layer 130, cold main fins 132, cold closure bars 134, cold inlet corner fins 136, cold outlet corner fins 138, cold inlet open corner 142, and cold outlet open corner 144. Also labeled in FIGS. 4A-4B are length L, width W, hot tent width A, and corner fin angle Θ. The descriptions of hot layer 10, hot fins 12, 14, 16, hot end closure bars 18, hot side closure bars 22, hot inlet tent 26, and hot outlet tent 28 are substantially similar to those provided above in regard to FIG. 2A. Hot inlet tent 26 and hot outlet tent 28 each have hot tent width A. Hot layer 10 and cold layer 130 each have length L and width W. As noted above in regard to FIGS. 3A-3B, length L can also be called layer length, and width W can also be called layer width.

Cold layer 130 includes three sets of fins: cold main fins 132, cold inlet corner fins 136 located near cold inlet open corner 142, and cold outlet corner fins 138 located near cold outlet open corner 144. Cold closure bars 134 each have a length corresponding to hot tent width A. It is noteworthy that cold closure bars 134 do not extend the full width W of cold layer 130, with portions of cold layer 130 being open in regions that are adjacent to cold closure bars 134. Accordingly, cold layer 130 can be described as an open concept, thereby providing a greater area for the cold fluid to enter and exit cold layer 130, which can result in improved thermodynamic performance (i.e., more effective cooling of a hot fluid flowing through hot layer 10). A heat exchanger (not shown) that includes cold layers 130 can be described as an open concept cross counter flow heat exchanger. In the illustrated embodiment, cold inlet air can be Cold inlet corner fins 136 and cold outlet fins 138 each have a fin direction that forms an angle Θ relative to the fin direction of cold main fins 132. This can be referred to as corner fin angle Θ, which can be selected to provide an optimum flow of cold air through cold layer 130 based on the relative sizes of cold inlet open corner 142 and cold outlet open corner 144. In the illustrated embodiment, corner fin angle Θ is approximately 50 deg. In some embodiments, corner fin angle Θ can range from 25-65 deg. In other embodiments, corner fin angle Θ can range from about 5-85 deg. Any corner fin angle Θ that is greater than 0 deg. and less than 90 deg. is within the scope of the present disclosure.

Figure 5A:
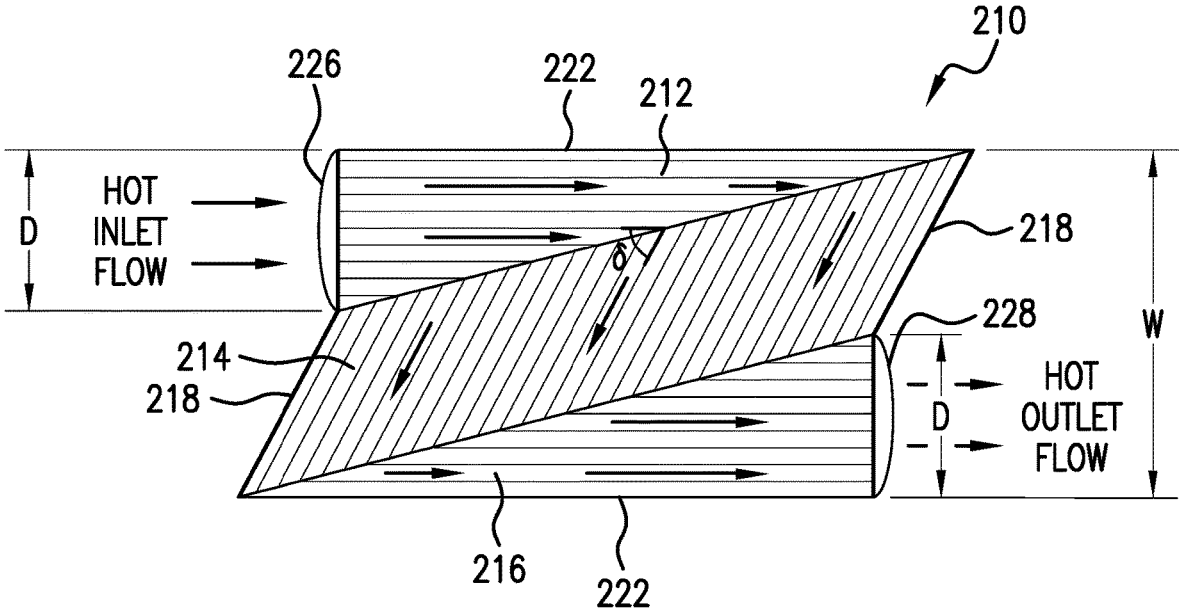
FIG. 5A is a top view of a hot layer of an offset/slanted cross counter flow heat exchanger.
Figure 5B:
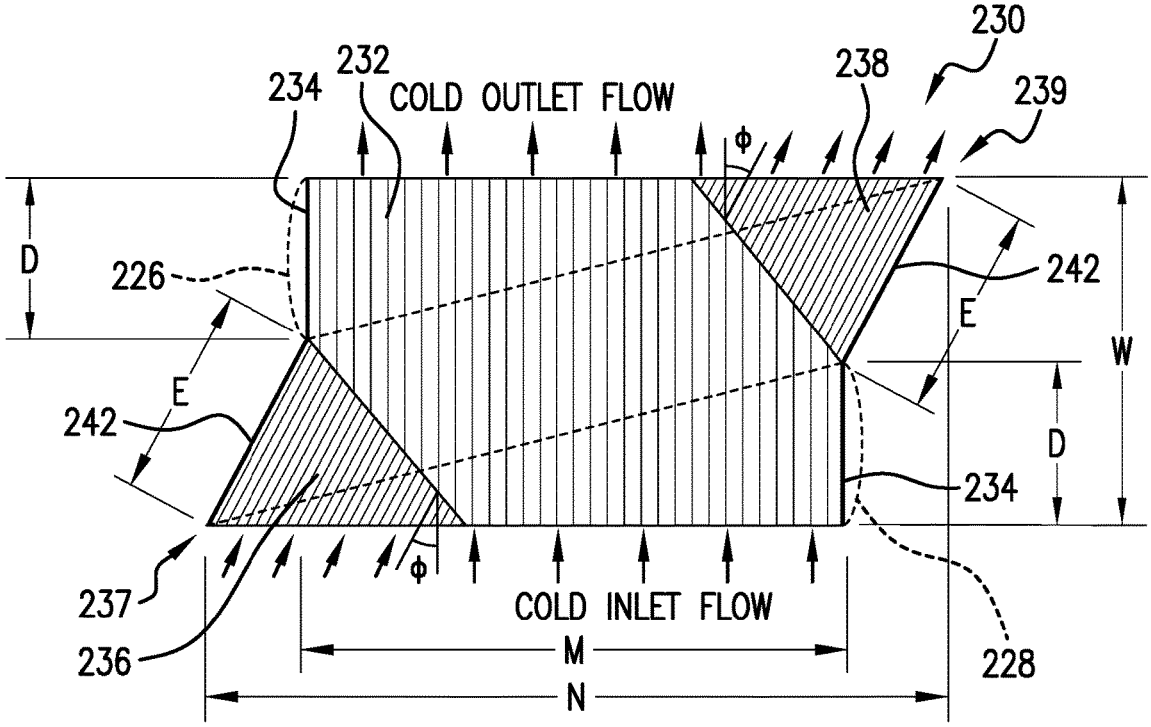
FIG. 5B is a top view of a cold layer of an offset/slanted cross counter flow heat exchanger.

FIG. 5A is a top view of a hot layer of an offset/slanted cross counter flow heat exchanger. FIG. 5B is a top view of a cold layer of an offset/slanted cross counter flow heat exchanger. Shown in FIGS. 5A-5B are hot layer 210, hot fins 212, 214, 216, hot end closure bars 218, hot side closure bars 222, hot inlet tent 226, hot outlet tent 228, cold layer 230, cold main fins 232, cold main closure bars 234, cold inlet corner fins 236, cold inlet offset corner 237, cold outlet corner fins 238, cold outlet offset corner 239, and cold offset closure bars 242. Also labeled in FIGS. 5A-5B are hot tent width D, main length M, envelope length N, width W, and corner fin angle ϕ. The descriptions of hot layer 210, hot fins 212, 214, 216, hot end closure bars 218, hot side closure bars 222, hot inlet tent 226, and hot outlet tent 228 are substantially as provided above in regard to FIG. 2A, with the exception that hot layer 210 is offset/slanted to accommodate cold layer 230, as described herein. Accordingly, hot fins 212, 214, 216 can also be referred to as inlet hot fin 212, middle hot fin 214, and outlet hot fin 216, respectively. Middle hot fins 214 form middle fin angle δ with inlet hot fins 212. In the illustrated embodiment, middle fin angle δ is about 55 deg. In some embodiments, middle fin angle δ can range from 25-65 deg. In other embodiments, middle fin angle δ can range from 5-90 deg. In yet other embodiments, middle fin angle δ can be greater than 90 deg.

Cold layer 230 includes three sets of fins: cold main fins 232, cold inlet corner fins 236 located near cold inlet offset corner 237, and cold outlet corner fins 238 located near cold outlet offset corner 239. Cold main fins 232 account for the majority of the fin area in cold layer 230, with cold main fins 232 having main length M as shown in FIG. 5B. Cold layer 230 can be described as having an "offset/slanted" concept, in which the heat exchanger (not shown) that is formed by alternating hot layers 210 and cold layers 230 can make maximum use of the available envelope of space in which the heat exchanger is located. As shown in FIG. 5B, cold inlet offset corner 237 and cold outlet offset corner 239 are both offset from cold main fins 232. The overall length of cold layer 230 is envelope length N, as shown in FIG. 5B. Accordingly, the overall length of hot layer 210 is also envelope length N. Two cold closure bar regions form the side boundaries of cold layer 230: cold main closure bars 234 being parallel to cold main fins 232, and cold offset closure bars 242 being parallel to cold inlet corner fins 236 and cold outlet corner fins 236, respectively. Accordingly, cold offset closure bars 242 are near a respective cold inlet offset corner 237 or cold outlet offset corner 239. Cold inlet corner fins 236 and cold outlet fins 238 each have a fin direction that forms an angle ϕ relative to the fin direction of cold main fins 232. This can be referred to as corner fin angle ϕ, which can be selected to provide an optimum amount offset for cold inlet and outlet offset corners 237, 239 in order to make maximum use of the available envelope of space in which the heat exchanger is located. In the illustrated embodiment, corner fin angle ϕ is approximately 40 deg. In some embodiments, corner fin angle ϕ can range from 25-65 deg. In other embodiments, corner fin angle ϕ can range from 5-85 deg. Any corner fin angle ϕ that is greater than 0 deg. and less than 90 deg. establishes an offset/slanted cross counter flow configuration, and is therefore within the scope of the present disclosure.

Referring again to FIGS. 5A-5B, because each cold main closure bar 234 has a length that is associated with hot tent width D, each cold main closure bar 234 therefore has cold main closure bar length D. Cold offset closure bars 242 have cold offset closure bar length E. In the illustrated embodiment, cold offset closure bar length E is greater than cold main closure bar length D. It is to be appreciated that in a particular embodiment, the value of cold offset closure bar length E can be calculated from width W, cold main closure bar length D (i.e., hot tent width D), and corner fin angle ϕ by using algebraic and trigonometric functions. In some embodiments, cold offset closure bar length E is less than cold main closure bar length D. In a particular embodiment, cold offset closure bar length E can be about equal to cold main closure bar length D. The ratio of cold offset closure bar length E to cold main closure bar length D can be referred to as the cold closure bar length ratio (E/D). In the illustrated embodiment, cold closure bar length ratio (E/D) is about 1.4. In some embodiments, cold closure bar length ratio (E/D) can range from 1.0-1.8. In other embodiments, cold closure bar length ratio (E/D) can range from 0.6-3.0. Any value of cold closure bar length ratio (E/D) is within the scope of the present disclosure. It is to be appreciated that similar values and ratios can be established for the length of hot end closure bar 218 relative to hot tent width A in hot layer 210 shown in FIG. 5A. Moreover, algebraic and trigonometric calculations can be used to derive envelope length N (i.e., the length of hot side closure bar 222) relative to other known values.

Referring again to FIG. 5B, the ratio of envelope length N to main length M can be referred to as the envelope utilization factor (N/M). In the illustrated embodiment, the envelope utilization factor (N/M) is about 1.4. In some embodiments, the envelope utilization factor (N/M) can range from 1.2-1.6. In other embodiments, the envelope utilization factor (N/M) can range from about 1.0-2.0. Any envelope utilization factor (N/M) that is greater than 1.0 establishes an offset/slanted cross counter flow configuration, and is therefore in the scope of the present disclosure.

Figure 6A:
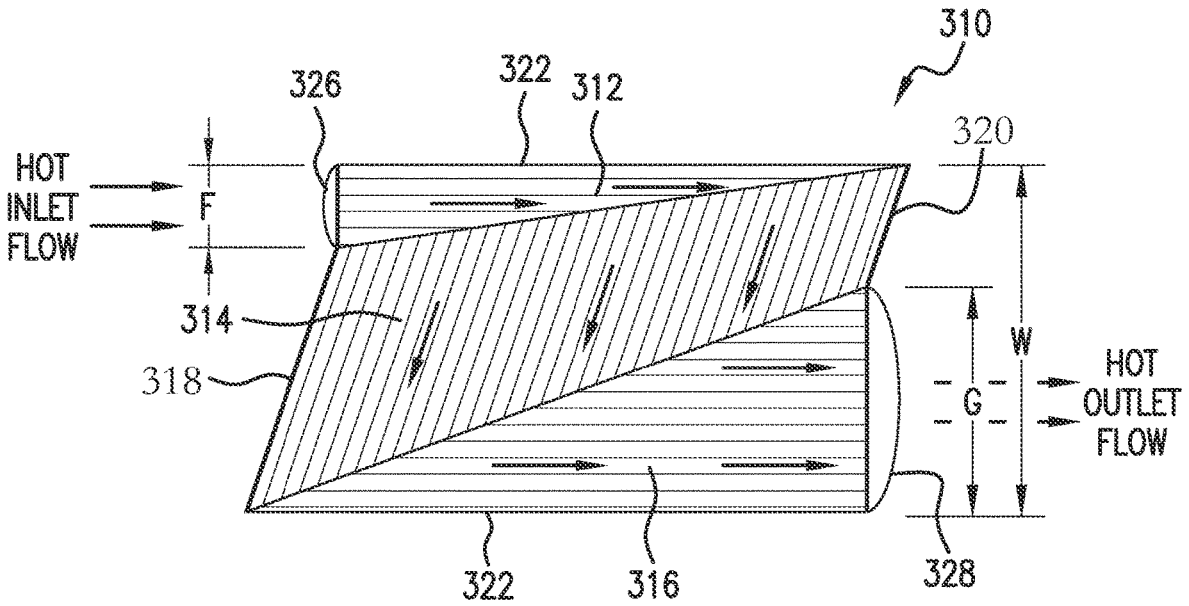
FIG. 6A is a top view of a hot layer of an asymmetric offset/slanted cross counter flow heat exchanger.
Figure 6B:
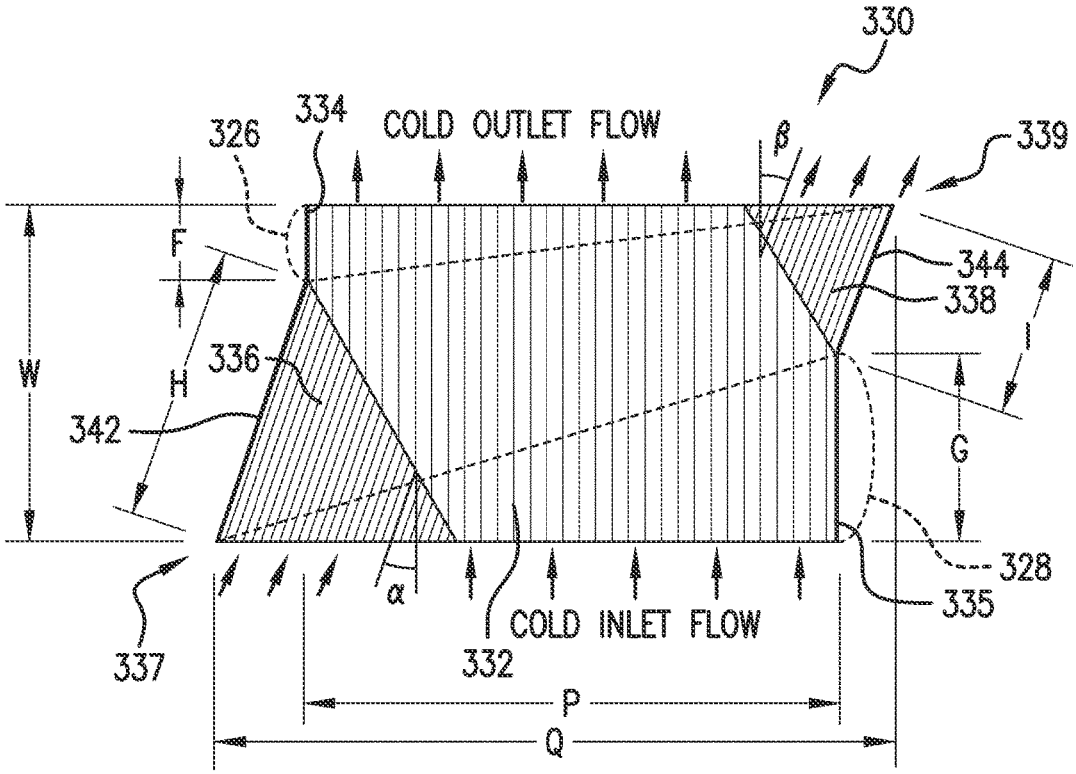
FIG. 6B is a top view of a cold layer of an asymmetric offset/slanted cross counter flow heat exchanger.

FIG. 6A is a top view of a hot layer of an asymmetric offset/slanted cross counter flow heat exchanger. FIG. 6B is a top view of a cold layer of an asymmetric offset/slanted cross counter flow heat exchanger. Shown in FIGS. 6A-6B are hot layer 310, inlet hot fin 312, middle hot fin 314, outlet hot fin 316, hot inlet closure bar 318, hot outlet closure bar 320, hot inlet side closure bar 322, hot outlet side closure bar 324, hot inlet tent 326, hot outlet tent 328, cold layer 330, cold main fin 332, first cold main closure bar 334, second cold main closure bar 335, cold inlet corner fin 336, cold inlet offset corner 337, cold outlet corner fin 338, cold outlet offset corner 339, first cold offset closure bar 342, and second cold offset closure bar 344. Also labeled in FIGS. 6A-6B are hot inlet tent width F (i.e., first cold main closure bar length), hot outlet tent width G (i.e., second cold main closure bar length), first cold offset closure bar length H, second cold offset closure bar length I, main length P, envelope length Q, width W, inlet corner fin angle α, and outlet corner fin angle β. The descriptions of hot layer 310, inlet hot fin 312, middle hot fin 314, outlet hot fin 316, hot inlet closure bar 318, hot outlet closure bar 320, hot inlet side closure bar 322, hot outlet side closure bar 324, hot inlet tent 326, and hot outlet tent 328 are substantially as provided above in regard to FIG. 3A. In particular, the reason for hot inlet tent width F being less than hot outlet tent width G is to reduce thermal stress on first cold main closure bars 334 and to reduce the resistance to flow of the hot fluid through hot layer 310, as described above in regard to FIG. 3A.

The descriptions of cold layer 330, cold main fin 332, first cold main closure bar 334, second cold main closure bar 335, cold inlet corner fin 336, cold inlet offset corner 337, cold outlet corner fin 338, cold outlet offset corner 339, first cold offset closure bar 342, and second cold offset closure bar 344 are substantially as provided above in regard to FIG. 5B. In particular, the reason for cold inlet and outlet offset corners 337, 339 is to make maximum use of the available envelope of space in which a heat exchanger (not shown) that uses hot and cold layers 310, 330 is located. It is to be appreciated that cold layer 330 includes the benefits of an asymmetric cross counter flow heat exchanger core, described above in regard to FIGS. 3A-3B), and an offset/slanted heat exchanger core, described above in regard to FIGS. 5A-5B. Accordingly, a heat exchanger core (not shown) that includes hot layers 310 and cold layers 330 can be referred to as utilizing an asymmetric offset/slanted cross counter flow concept.

Cold inlet corner fins 336 have a fin direction that forms an angle $\alpha$ relative to the fin direction of cold main fins 332. This can be referred to as inlet corner fin angle $\alpha$, which can be selected to provide an optimum amount of offset for cold inlet offset corner 337 in order to make maximum use of the available envelope of space in which the heat exchanger is located. Similarly, cold outlet corner fins 338 have a fin direction that forms an angle $\beta$ relative to the fin direction of cold main fins 332. This can be referred to as outlet corner fin angle $\beta$, which can be selected to provide an optimum amount of offset for cold outlet offset corner 339 in order to make maximum use of the available envelope of space in which the heat exchanger is located. In the illustrated embodiment, inlet corner fin angle $\alpha$ and outlet corner fin angle $\beta$ are both approximately 40 deg. In some embodiments, inlet and outlet corner fin angles $\alpha$, $\beta$ can range from 25-55 deg. In other embodiments, inlet and outlet corner fin angles $\alpha$, $\beta$ can range from 0-75 deg. In the illustrated embodiment, inlet corner fin angle $\alpha$ and outlet corner fin angle $\beta$ are about similar. In any particular embodiment, inlet corner fin angle $\alpha$ can be either greater than or less than outlet corner fin angle $\beta$. Any inlet corner fin angles $\alpha$ and/or outlet corner fin angle $\beta$ that is greater than 0 deg. establishes an offset/slanted cross counter flow configuration, and is therefore in the scope of the present disclosure. It is to be appreciated that in a particular embodiment, the value of first cold offset closure bar length H can be calculated from width W, first cold main closure bar length F (i.e., hot inlet tent width F), and inlet corner fin angle $\alpha$ by using algebraic and trigonometric functions. Similarly, in a particular embodiment, the value of second cold offset closure bar length I can be calculated from width W, second cold main closure bar length G (i.e., hot outlet tent width G), and outlet corner fin angle $\beta$.

In the illustrated embodiment shown in FIG. 6B, first cold offset closure bar length H is greater than second cold offset closure bar length I. In some embodiments, first cold offset closure bar length H can be less than second cold offset closure bar length I. In a particular embodiment, first cold offset closure bar length H can be about equal to second cold offset closure bar length I. The ratio of first cold offset closure bar length H to second cold offset closure bar length I can be referred to as the cold offset closure bar length ratio (H/I). In the illustrated embodiment, cold offset closure bar length ratio (H/I) is about 1.6. In some embodiments, cold offset closure bar length ratio (H/I) can range from 1.0-2.0. In other embodiments, cold offset closure bar length ratio (H/I) can range from 0.6-3.0. Any value of cold offset closure bar length ratio (H/I) is within the scope of the present disclosure. It is to be appreciated that similar values and ratios can be established for the length of hot end closure bar 218 relative to hot tent width A in hot layer 210 shown in FIG. 5A. Moreover, algebraic and trigonometric calculations can be used to derive envelope length N (i.e., the length of hot side closure bar 222) relative to other known values.

The ratio of hot inlet tent width F to width W can be referred to as the cold closure bar stress ratio (F/W), as described above in regard to FIG. 3A. In the illustrated embodiment, the cold closure bar stress ratio (F/W) is approximately 25%. The cold closure bar stress ratio (F/W) is also a measure of the length of first cold main closure 334 to width W. In some embodiments, the cold closure bar stress ratio (F/W) can range from 20-40%. In other embodiments, the cold closure bar stress ratio can range from 15-50%. The ratio of G/W can be referred to as the hot outlet flow ratio, as described above in regard to FIG. 3A. The hot outlet flow ratio (G/W) is also a measure of the length of second cold main closure 335 to width W. In the illustrated embodiment, the hot outlet flow ratio (G/W) is approximately 60%. In some embodiments, the hot outlet flow ratio (G/W) can range from 50-90%. Several other ratios and identities can be defined, in a manner similar to that described above in regard to FIG. 5B.

Referring again to FIG. 6B, the ratio of envelope length Q to main length P can be referred to as the envelope utilization factor (Q/P) is about 1.3. In some embodiments, the envelope utilization factor (Q/P) can range from 1.2-1.6. In other embodiments, the envelope utilization factor (Q/P) can range from about 1.0-2.0. Any envelope utilization factor (Q/P) that is greater than 1.0 establishes an offset/slanted cross counter flow configuration, and is therefore in the scope of the present disclosure.

Referring back to FIGS. 5A and 6A, it can be seen that inlet hot fins 212, 312 form an angle with middle hot fins 214, 314 that is greater than 90 deg. Similarly, middle hot fins 214, 314 form an angle with outlet hot fins 216, 316 that is greater than 90 deg. In the illustrated embodiments, inlet hot fins 212, 312 form an angle with middle hot fins 214, 314 that is about 125 deg. Because the fin direction established the flow direction in a particular section of fins, it can also be said that in the illustrated embodiments, the direction of flow in the middle section forms an angle with the direction of flow in the inlet section that is about 125 deg. In some embodiments, inlet hot fins 212, 312 can form an angle with middle hot fins 214, 314 that ranges from 110 to about 150 deg. In other embodiments, inlet hot fins 212, 312 can form an angle with middle hot fins 214, 314 that ranges from 95 to about 165 deg. In yet other embodiments, inlet hot fins 212, 312 can form an angle with middle hot fins 214, 314 that ranges from 90 to about 180 deg.

The present disclosure provides exemplary embodiments of hot and cold layers for use in cross counter flow plate fin heat exchanger cores. The term "hot layer" (i.e., hot layer 10, 110, 210, 310) refers to a particular layer of a cross counter flow plate fin heat exchanger core that is configured to receive a hot fluid from an external system. Accordingly, "hot" is used as an identifying term to distinguish the particular layer from another layer (e.g., a cold layer), and does not refer to a particular temperature of the layer in the absence of a fluid flowing therethrough. Hot layer 10, 110, 210, 310 can be referred to as a first layer, and a hot fluid can be referred to as a first fluid. Similarly, the term "cold layer" (i.e., cold layer 30, 130, 230, 330) refers to a particular layer of a cross counter flow plate fin heat exchanger core that is configured to receive a cold fluid from an external system. Accordingly, "cold" is used as an identifying term to distinguish the particular layer from another layer (e.g., a hot layer), and does not refer to a particular temperature of the layer in the absence of a fluid flowing therethrough. Cold layer 30, 130, 230, 330 can be referred to as a second layer, and a cold fluid can be referred to as a second fluid. It is to be appreciated that in the thermodynamic art, heat transfer (i.e., heat exchange) occurs by heat transfer (i.e., flow) from a higher temperature to a lower temperature. Accordingly, a heat exchanger that includes hot layers 10, 110, 210, 310 and cold layers 30, 130, 230, 330 will effect heat exchange by a difference in temperature between a hot (i.e., first) fluid and a cold (i.e., second) fluid.

In the various embodiments shown in FIGS. 3A-6B, length L is depicted as being greater than width W. In some embodiments, width W can be greater than length L. In a particular embodiment, length L can be approximately equal to width W. Hot layers 10, 110, 210, 310 and cold layers 30, 130, 230, 330 of the present disclosure can have any relationship between length L and width W, because of a wide range of possible configurations for a particular application. Accordingly, all values of length L and width W are within the scope of the present disclosure. Moreover, all values of envelope length N, Q are within the scope of the present disclosure. For example, in a particular embodiment, width W can range from about 3 inches (7.5 cm) to about 12 inches (30 cm). In some embodiments, width W can be less than about 3 inches (7.5 cm). In other embodiments, width W can range from about 12 inches (30 cm) to about 39 inches (1 meter). In yet other embodiments, width W can be more than about 39 inches (1 meter). It is to be appreciated that values of length L and envelope length N, Q can scale with a particular width W. Moreover, it is to be appreciated that values disclosed herein are approximate, having only one or two digits of precision.

It is to be appreciated that adjacent hot layers 10, 110, 210, 310 and cold layers 30, 130, 230, 330 are separated by a parting sheet (e.g., parting sheet 40, as shown in FIG. 1), with a plurality of alternating hot and cold layers generally being sandwiched between a top and bottom end sheet (not shown). In a particular embodiment, the various components of hot layers 10, 110, 210, 310 and cold layers 30, 130, 230, 330 can be made of metal or a metal alloy. Non-limiting examples of metallic materials that can be used include nickel, aluminum, titanium, copper, iron, cobalt, and all alloys that include these various metals. In an exemplary manufacturing process, alternating hot and cold layers are stacked and held in position by a brazing fixture and placed into a brazing furnace for a metallurgical joining together of the various components. A brazing material can be applied to the outer surfaces of the various fins, closure bars, and parting sheets to facilitate the metallurgical joining process. An exemplary brazing process can include evacuating the air from the brazing furnace so that the stacked heat exchanger core components are in a vacuum. Next, the temperature in the brazing furnace is increased to at least the brazing melt temperature and held for a period of time to allow the brazing material to melt. The brazing furnace temperature is then lowered, thereby allowing the brazing material to solidify, and the brazing furnace can be backfilled by an inert gas. An annealing cycle can also be performed in some embodiments. All means of metallurgical joining are within the scope of the present disclosure. For example, in some embodiments, alternating hot and cold layers can be metallurgically joined by a welding process. Exemplary welding processes include electron beam and plasma welding.

In other embodiments, the various components of hot layers 10, 110, 210, 310 and cold layers 30, 130, 230, 330 can be made of a plastic, ceramic, composite material, or any other material that is suitable for use in plate fin heat exchangers. All manufacturing processes for hot layers 10, 110, 210, 310 and cold layers 30, 130, 230, 330 are within the scope of the present disclosure, including without limitation additive manufacturing, hybrid additive subtractive manufacturing, subtractive manufacturing, or casting. Accordingly, in a particular embodiment, hot layers 10, 110, 210, 310 and/or cold layers 30, 130, 230, 330 can be made from an assortment of similar or dissimilar materials that are joined together by one or more of any possible manufacturing process.

DISCUSSION OF POSSIBLE EMBODIMENTS

A hot layer adapted for use in an asymmetric cross counter flow heat exchanger core that includes a plurality of alternating hot and cold layers, a hot inlet tent configured to receive a hot inlet flow and defining a hot inlet tent width, and a hot outlet tent configured to discharge a hot outlet flow and defining a hot outlet tent width, the hot layer comprising: a plurality of inlet hot fins defining an inlet fin direction; a plurality of middle hot fins defining a middle fin direction; a plurality of outlet hot fins defining an outlet fin direction; a hot inlet closure bar, disposed adjacent to the hot inlet tent; a hot outlet closure bar, disposed adjacent to the hot outlet tent; and two hot side closure bars, disposed adjacent to respective corresponding inlet hot fins and outlet hot fins; wherein: an angle between the inlet fin direction and the middle fin direction ranges from 5-175 degrees; and the hot inlet tent width is less than the hot outlet tent width.

The hot layer of the preceding paragraph can optionally include, additionally and/or alternatively, any one or more of the following features, configurations and/or additional components:

A further embodiment of the foregoing hot layer, further comprising a heat exchanger core and at least one cold layer, each of the at least one cold layers including a cold closure bar located proximate the hot inlet tent.

A further embodiment of the foregoing hot layer, wherein: the angle between the inlet fin direction and the middle fin direction is about 90 degrees; the hot layer defines a rectangular structure having a layer length in a direction of the inlet hot fins and a layer width in a direction that is perpendicular to the layer length; the hot inlet tent defines a hot inlet tent width; a ratio of the hot inlet tent width to the layer width ranges from 5-50%.

A further embodiment of the foregoing hot layer, wherein the ratio of the hot inlet tent width to the layer width ranges from 25-40%.

A further embodiment of the foregoing hot layer, wherein the ratio of the hot inlet tent width to the layer width ranges is about 30%.

A further embodiment of the foregoing hot layer, wherein: the hot layer defines a rectangular structure having a layer length in a direction of the inlet hot fins and a layer width in a direction that is perpendicular to the layer length; the hot outlet tent defines a hot outlet tent width; and a ratio of the hot outlet tent width to the layer width ranges from 50-90%.

A further embodiment of the foregoing hot layer, wherein the ratio of the hot outlet tent width to the layer width ranges from 65-80%.

A further embodiment of the foregoing hot layer, wherein the ratio of the hot outlet tent width to the layer width is about 75%.

A further embodiment of the foregoing hot layer, wherein: the layer length ranges from 2.5-30 cm (1-12 inches); and the layer width ranges 2.5-30 cm (1-12 inches).

A further embodiment of the foregoing hot layer, wherein: the layer length is greater than 30 cm (12 inches); or the layer width is greater than 30 cm (12 inches); or the layer length and layer width are both greater than 30 cm (12 inches).

A further embodiment of the foregoing hot layer, further comprising a flow restrictor disposed near the hot outlet closure bar, configured to restrict flow through the inlet hot fins, the middle hot fins, and/or the outlet hot fins, thereby reducing a short-circuit of flow from the hot inlet tent to the hot outlet tent.

A further embodiment of the foregoing hot layer, wherein the flow restrictor comprises a plate that is selected from the group consisting of a perforated plate and a partial height plate.

A further embodiment of the foregoing hot layer, wherein the flow restrictor comprises a non-uniform fin configuration having of a variation in fin density and/or fin type.

A further embodiment of the foregoing hot layer, wherein the inlet hot fins, middle hot fins, and outlet hot fins each comprise one or more of nickel, aluminum, titanium, copper, iron, cobalt, or alloys thereof.

A further embodiment of the foregoing hot layer, wherein the inlet hot fins, middle hot fins, and outlet hot fins each comprise one or more of plastic, ceramic, or composite material.

A further embodiment of the foregoing hot layer, wherein: the hot inlet flow comprises a hot gas; the hot gas defines a hot inlet flow temperature; and the hot inlet flow temperature ranges from 32 degrees F. (0 degrees C.) to 1,200 degrees F. (649 degrees C.).

A further embodiment of the foregoing hot layer, further comprising an asymmetric cross counter flow heat exchanger.

A hot layer adapted for use in an asymmetric cross counter flow heat exchanger core that includes a plurality of alternating hot and cold layers, a hot inlet tent configured to receive a hot inlet flow and defining a hot inlet tent width, and a hot outlet tent configured to discharge a hot outlet flow and defining a hot outlet tent width, the hot layer comprising: a plurality of inlet hot fins defining an inlet fin direction; a plurality of middle hot fins defining a middle fin direction; a plurality of outlet hot fins defining an outlet fin direction; a hot inlet closure bar, disposed adjacent to the hot inlet tent; a hot outlet closure bar, disposed adjacent to the hot outlet tent; and two hot side closure bars, disposed adjacent to respective corresponding inlet hot fins and outlet hot fins; wherein: the hot inlet tent width is less than the hot outlet tent width; and an angle between the inlet fin direction and the middle fin direction is less than 90 degrees.

The hot layer of the preceding paragraph can optionally include, additionally and/or alternatively, any one or more of the following features, configurations and/or additional components:

A further embodiment of the foregoing hot layer, wherein the angle between the inlet fin direction and the middle fin direction ranges from 5-85 degrees.

A further embodiment of the foregoing hot layer, further comprising a heat exchanger core and at least one cold layer, each of the at least one cold layers adapted for use with hot layer middle section.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A hot layer adapted for use in an asymmetric cross counter flow heat exchanger core that includes a plurality of alternating hot and cold layers, the hot layer comprising:

a plurality of inlet hot fins defining an inlet fin direction;

a plurality of middle hot fins defining a middle fin direction;

a plurality of outlet hot fins defining an outlet fin direction;

a hot inlet closure bar on a first end of the hot layer and extending along the plurality of middle hot fins;

a hot outlet closure bar on a second end of the hot layer and extending along the plurality of middle hot fins;

a first hot side closure bar on a first side of the hot layer and disposed adjacent to the inlet hot fins;

a second hot side closure bar on a second side of the hot layer and disposed adjacent to the outlet hot fins;

a hot inlet on the first end of the hot layer and extending between the hot inlet closure bar and the first hot side closure bar and having a hot inlet width, wherein the hot inlet is configured to receive a hot inlet flow of a hot fluid that enters the hot layer at the hot inlet; and a hot outlet on the second end of the hot layer and extending between the hot outlet closure bar and the second hot side closure bar and having a hot outlet width, wherein the hot outlet is configured to discharge a hot outlet flow of a cooled hot fluid;

wherein:

an angle between the inlet fin direction and the middle fin direction ranges from 5-175 degrees; and the hot inlet width on the first end of the hot layer is less than the hot outlet width on the second end of the hot layer;

a hot inlet closure bar width of the hot inlet closure bar is greater than a hot outlet closure bar width of the hot outlet closure bar; and the hot layer having a layer length in a direction of the inlet hot fins and a layer width in a direction that is perpendicular to the layer length, wherein a ratio of the hot inlet width on the first end of the hot layer to the layer width ranges from 5-50%, and wherein a ratio of the hot outlet width on the second end of the hot layer to the layer width ranges from 50-90%.

2. A heat exchanger core comprising the hot layer of claim 1 and at least one cold layer, each of the at least one cold layers including a cold closure bar located proximate the hot inlet.

3. The hot layer of claim 1, wherein:

the angle between the inlet fin direction and the middle fin direction is 90 degrees.

4. The hot layer of claim 1, wherein the ratio of the hot inlet width to the layer width ranges from 25-40%.

5. The hot layer of claim 1, wherein the ratio of the hot inlet width to the layer width ranges is 30%.

6. The hot layer of claim 1, wherein:

the hot layer defines a rectangular structure.

7. The hot layer of claim 1, wherein the ratio of the hot outlet width to the layer width ranges from 65-80%.

8. The hot layer of claim 1, wherein the ratio of the hot outlet width to the layer width is 75%.

9. The hot layer of claim 6, wherein:

the layer length ranges from 2.5-30 cm (1-12 inches); and the layer width ranges 2.5-30 cm (1-12 inches).

10. The hot layer of claim 6, wherein:

the layer length is greater than 30 cm (12 inches); or the layer width is greater than 30 cm (12 inches); or the layer length and layer width are both greater than 30 cm (12 inches).

11. The hot layer of claim 1, further comprising a flow restrictor disposed near the hot outlet closure bar, configured to restrict flow through the inlet hot fins, the middle hot fins, and/or the outlet hot fins, thereby reducing a short-circuit of flow from the hot inlet to the hot outlet.

12. The hot layer of claim 11, wherein the flow restrictor comprises a plate that is selected from the group consisting of a perforated plate and a partial height plate.

13. The hot layer of claim 11, wherein the flow restrictor comprises a non-uniform fin configuration having of a variation in fin density and/or fin type.

14. The hot layer of claim 1, wherein the inlet hot fins, middle hot fins, and outlet hot fins each comprise one or more of nickel, aluminum, titanium, copper, iron, cobalt, or alloys thereof.

15. The hot layer of claim 1, wherein the inlet hot fins, middle hot fins, and outlet hot fins each comprise one or more of plastic, ceramic, or composite material.

16. The hot layer of claim 1, wherein:

the hot inlet flow comprises a hot gas;

the hot gas defines a hot inlet flow temperature; and the hot inlet flow temperature ranges from 32 degrees F. (0 degrees C.) to 1,200 degrees F. (649 degrees C.).

17. An asymmetric cross counter flow heat exchanger, comprising the hot layer of claim 1.

18. A hot layer adapted for use in an asymmetric cross counter flow heat exchanger core that includes a plurality of alternating hot and cold layers, the hot layer comprising:

a plurality of inlet hot fins defining an inlet fin direction;

a plurality of middle hot fins defining a middle fin direction;

a plurality of outlet hot fins defining an outlet fin direction;

a hot inlet closure bar on a first end of the hot layer and extending along the plurality of middle hot fins;

a hot outlet closure bar on a second end of the hot layer and extending along the plurality of middle hot fins;

a first hot side closure bar on a first side of the hot layer and disposed adjacent to the inlet hot fins;

a second hot side closure bar on a second side of the hot layer and disposed adjacent to the outlet hot fins;

a hot inlet on the first end of the hot layer and extending between the hot inlet closure bar and the first hot side closure bar and having a hot inlet width, wherein the hot inlet is configured to receive a hot inlet flow of a hot fluid that enters the hot layer at the hot inlet; and a hot outlet on the second end of the hot layer and extending between the hot outlet closure bar and the second hot side closure bar and having a hot outlet width, wherein the hot outlet is configured to discharge a hot outlet flow of a cooled hot fluid;

wherein:

the hot inlet width on the first end of the hot layer is less than the hot outlet width on the second end of the hot layer;

a hot inlet closure bar width of the hot inlet closure bar is greater than a hot outlet closure bar width of the hot outlet closure bar;

the hot layer having a layer width in a direction of the middle hot fins, wherein a ratio of the hot inlet width on the first end of the hot layer to the layer width ranges from 5-50%, and wherein a ratio of the hot outlet width on the second end of the hot layer to the layer width ranges from 50-90%; and an angle between the inlet fin direction and the middle fin direction is less than 90 degrees.

19. The hot layer of claim 18, wherein the angle between the inlet fin direction and the middle fin direction ranges from 5-85 degrees.

20. A heat exchanger core comprising the hot layer of claim 18 and at least one cold layer, each of the at least one cold layers adapted for use with hot layer middle section.

* * * * *